United States Patent [19]

Pearson

[11] 4,213,479

[45] Jul. 22, 1980

[54] EDUCTION UNIT

[75] Inventor: Leland E. Pearson, Galva, Ill.

[73] Assignee: Industrial & Municipal Engineering, Inc., Galva, Ill.

[21] Appl. No.: 958,332

[22] Filed: Nov. 7, 1978

[51] Int. Cl.[2] ..... B08B 9/08; B08B 13/00

[52] U.S. Cl. ..... 137/493; 137/205; 137/351; 137/578; 141/65; 210/117; 210/241

[58] Field of Search ..... 137/205, 351, 578, 493, 137/493.7, 493.8, 493.9; 141/59, 65; 210/117, 241; 222/205

[56] References Cited

U.S. PATENT DOCUMENTS

| | | | |
|---|---|---|---|
| Re. 27,346 | 4/1972 | Naylor | 210/241 X |
| 2,664,911 | 1/1954 | Thompson et al. | 137/205 |
| 3,424,186 | 1/1969 | Sparks | 137/205 |
| 3,621,893 | 11/1971 | Nishimura | 137/205 X |
| 3,971,400 | 7/1976 | Thompson | 137/205 |
| 4,057,364 | 11/1977 | Bratschitsch | 137/205 X |

*Primary Examiner*—Robert G. Nilson

*Attorney, Agent, or Firm*—Hill, Van Santen, Steadman, Chiara & Simpson

[57] ABSTRACT

A portable eduction unit includes a tank, a single first hose for extending into a source of solids and liquid, such hose being connected to the tank through a check valve which opens in response to a partial vacuum in the tank. A hose within the tank has one end supported by a float and communicates with the first hose through a check valve that opens in response to pressurization of the tank, and a shut-off valve for controlling the flow between the first-mentioned hose and the check valves.

9 Claims, 3 Drawing Figures

EDUCTION UNIT

BACKGROUND OF THE INVENTION

1. Field of the Invention

This invention relates to a water transfer system constructed to enable the separation of solids from the water, and to be moved about from place to place.

2. Prior Art

There have been a number of wheeled trailers or trucks proposed which withdraw water containing solids from catch basins, septic tanks, sewers or the like, and which discharge the withdrawn water into a tank on the vehicle. After the solids have settled, water is returned from such tank to its source. In such devices, there have typically been employed two or three hoses that extend from the vehicle to the catch basin or other source. A typical construction of this type is shown in U.S. Pat. No. Re. 27,346 which teaches the use of a suction line extending from a pump to a hose that can be inserted at some point in a sewer system, and a separate discharge line which extends from the tank to a second hose that also leads to the sewage system.

SUMMARY OF THE INVENTION

According to the present invention, an eduction unit comprises a portable tank, a single first hose leading from the top of the tank to the catch basin or other source, a normally closed first check valve communicating an end of the first hose with the interior of the tank, a second hose disposed inside the tank, one end of which is connected by a second check valve to the first hose. Depending upon internal pressure in the tank, water with solids is drawn upwardly through the first hose and is discharged into the tank where the solids can settle, or water from the tank is returned through the single hose that extends to the source.

Accordingly, it is an object of the present invention to provide an eduction unit which can be truck-mounted and which uses a single hose between the tank and the catch basin or other source.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

Figure 1:
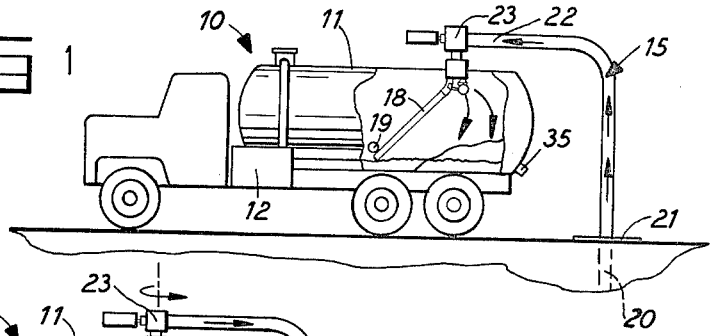
Figure 2:
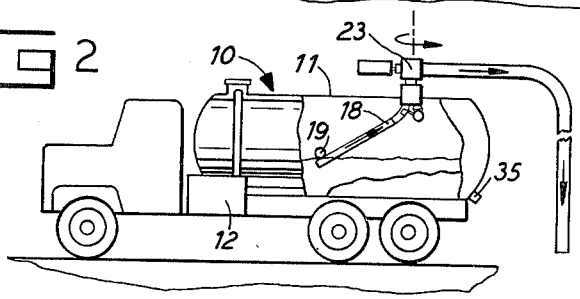
Figure 3:
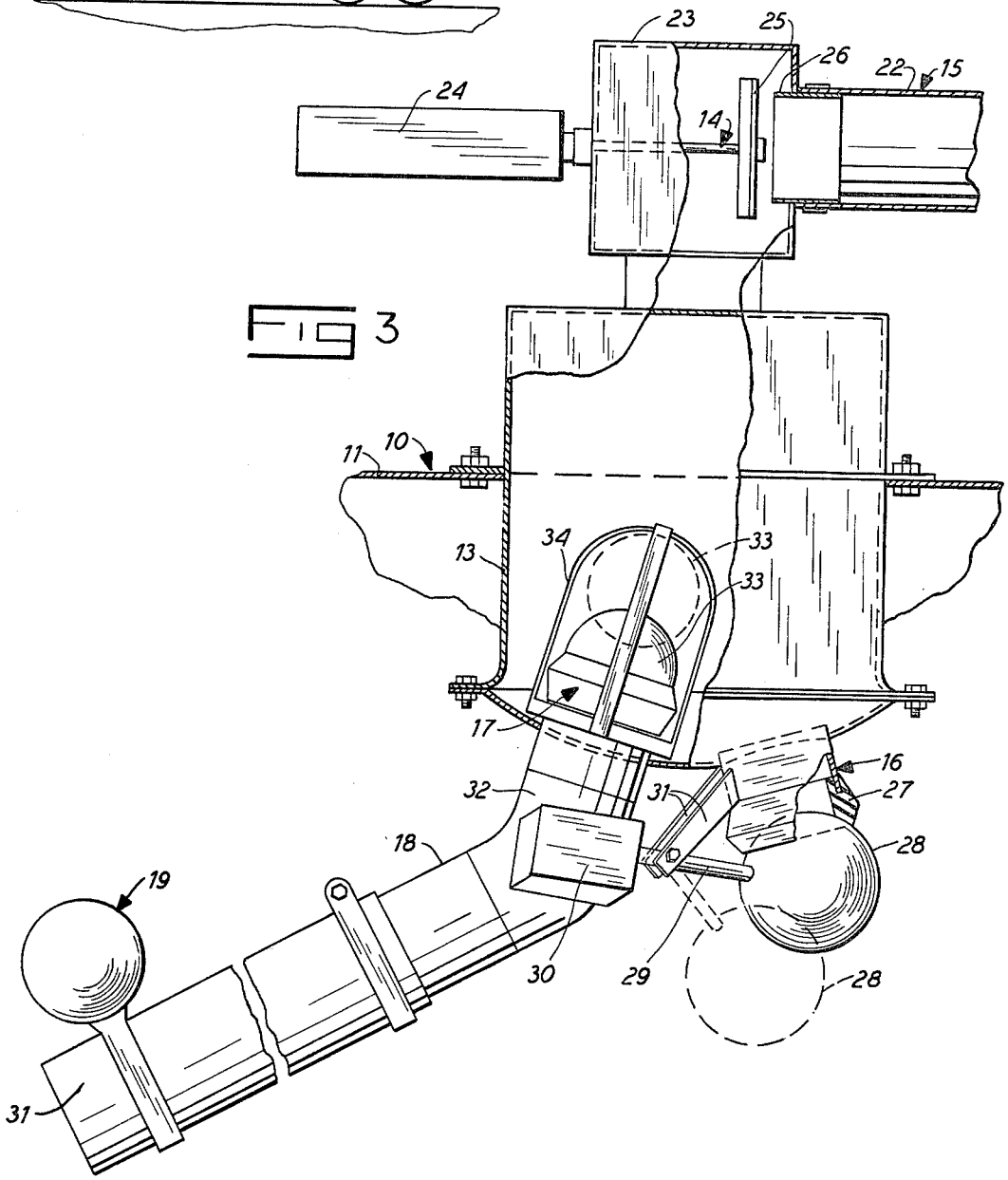

FIG. 1 is a diagrammatic elevational view showing an eduction unit transferring water and solids from a catch basin or other source to the tank;

FIG. 2 corresponds to FIG. 1, but illustrates the transfer of water, minus any solids, from the tank to the catch basin or other source; and FIG. 3 is an enlarged fragmentary cross-sectional view of the eduction unit.

AS SHOWN ON THE DRAWINGS

The principles of the present invention are particularly useful when embodied in an eduction unit such as shown in the drawings, generally indicated by the numeral 10. The eduction unit 10 includes a portable tank 11 having a pump 12, a hollow casing 13, the hollow casing 13 supporting a shut-off valve 14, a first hose 15, a first check valve 16, a second check valve 17, and one end of a second hose 18, the eduction unit 10 further including a float 19.

The tank 11 is capable of being evacuated by the pump 12 when the shut-off valve 14 is closed, while the unit 10 is en route to its destination. The pump 12 can also be used to pressurize the tank 11 when a rotary valve (not shown) has been moved. Thus the pump 12 can evacuate or pressurize the tank 11 with respect to atmospheric pressure.

The first single hose 15 is preferably carried on a boom (not shown), a lower end 20 of the hose 15 being insertable into a mixture of solids and liquids, for example as might be contained in a septic tank or catch basin, a cover of which is indicated at 21. The other end 22 of the hose 15 communicates with ther interior of the tank 11, the hose 15 having a horizontal extent at said other end 22 which goes beyond the end of the tank.

The other end 22 of the hose 15 is secured to a portion 23 of the hollow casing 13 which is pivotable about a vertical axis as shown by the arrow in FIG. 2. Thus the lower end 20 of the hose 15 can be extended to sources located on either side of the eduction unit 10 or located rearwardly thereof.

The shut-off valve 14 includes an actuator 24 which may be pneumatically, hydraulically, or manually operated to open and close the valve 14. The valve 14 has a valve element 25 which is faced with or coated with rubber for coacting with a seat 26 supported by the pivotable portion 23 of the hollow casing 13 and communicating with the adjacent end 22 of the hose 15.

The construction of the hollow casing 13 that is illustrated is diagrammatic, but it is so arranged and constructed that there is a pressure-tight seal made between it and the tank 11, and so that it can be partially disassembled for purposes such as installation, maintenance, or the like. The hollow portion of the casing 13 provides fluid communication between the hose 15 and the check valves 16, 17. The fluid connection or communication thus provided can be interrupted or closed by the shut-off valve 14.

When there is a partial vacuum in the tank 11, and the lower end 20 of the hose 15 is inserted in a mixture of liquids and solids, the shut-off valve 14 is then opened. Atmospheric pressure acting on liquid in the basin 21 then forces the mixture to flow upwardly as shown in FIG. 1, and such flow opens the check valve 16 to discharge the mixture into the tank 11.

The check valve 16 is normally closed, but with the presence of a sub-atmospheric pressure on its downstream side, it is caused to open. The check valve 16 has a mount that is welded to the casing 13, and includes a rubber seat 27 that faces generally downwardly. The check valve 16 includes a valve element 28, here comprising a hollow ball of stainless steel to which is welded one end of a generally horizontal lever 29, there being a weight 30 secured to the other end of the lever 29, the lever 29 being pivoted between the ball 28 and the weight 30 on a pair of brackets 31, 31 welded to the base of the check valve 16. The mass of the weight 30 is sufficient so that the force of gravity acting thereon will keep the check valve 16 normally in a closed position. As partially shown in broken lines, the valve element 28 is pivotable in a generally vertical direction. Once the lower end of the hose 15 has been inserted in liquid, the pump 12 can continue to remove air from the tank. When the eduction unit 10 has removed all the mixture that it can reach, then air will be drawn in and the partial vacuum will be broken, thus enabling the check valve 16 to close.

The second hose 18 has a lower end 31 which extends into any liquid in the tank 10 as shown in FIG. 1. As the water level rises in the tank 11, the float 19 raises the lower end 31 of the hose 18 to keep it just below the surface of the water as shown in FIG. 2. The other end 32 of the hose 18 is secured to the check valve 17 and enables the end 31 of the hose 18 to move generally vertically, the connection being here illustrated as being flexible for such purpose. The location and the bouyancy of the float 19 are such that the float cannot raise the end 31 up to the surface of the water in the tank.

The second check valve 17 is also normally closed and is generally constructed like the first check valve 16, except that it is disposed inside the hollow casing 13 rather than outside of it. With this arrangement, the valve seat faces generally upwardly, and gravity will act on a similar stainless steel ball 33 to close the check valve 17. The valve element or ball 33 is loose and is encircled with a fixed cage 34 which functions to restrict the travel of the valve element 33 away from its seat as shown in broken lines, and the cage 34 also functions to guide the travel of the loose valve element back to the valve seat.

After the partial vacuum has been broken as described above, the shut-off valve 14 is reclosed, and the control valve (not shown) of the pump 12 is repositioned so that the pump 12 pressurizes the space in the tank 11 above the water. Such pressurization may continue until enough time has elapsed to produce the desired degree of settling of solids. Then the shut-off valve is opened, and the pressurized air in the tank 11 will force liquid to flow through the hose 18, the resulting pressure acting to unseat the check valve 17 and to force the water through the casing 13, through the open shut-off valve 14 and out through the hose 15 as shown diagrammatically in FIG. 2 for return to the source. Such flow continues until pressurized air passes through the single external hose 15.

At that time, the shut-off valve 14 may be reclosed and the pump 12 reset for providing a partial vacuum in the tank as the eduction unit 10 is moved to the next location.

The tank 11 is provided with other fittings shown schematically at 35 which are coupled to appropriate apparatus for emptying the solids from the tank 11.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An eduction unit comprising:

(a) a portable tank arranged to be selectively evacuated or pressurized to internal pressures respectively below and above atmosphere pressure;

(b) a single first hose adapted at one end to be inserted into a mixture of solids and liquids external to said tank, said first hose being supported at its other end at the top of said tank;

(c) a normally closed first check valve communicating said other end of said first hose with the interior of said tank, and openable in response to said tank's being partially evacuated;

(d) a second hose adapted at one end to be inserted into any liquid contents within said tank, said second hose being supported at its other end near the top of said tank; and (e) a normally closed second check valve communicating said other end of said first hose with said other end of said second hose, and openable in response to said tank's being pressurized above atmospheric pressure.

2. An eduction unit according to claim 1, including a hollow casing secured to said tank, said casing supporting said hoses and said check valves, and fluidly interconnecting said other end of said first hose with said check valves.

3. An eduction unit according to claim 2, including a shut-off valve carried on said casing, and arranged to open and close the fluid interconnection between said first hose and said check valves.

4. An eduction unit according to claim 1 in which both of said check valves are normally biased to a closed position by gravity.

5. An eduction unit according to claim 4, in which said first check valve includes a downwardly directed seat, a normally generally horizontal lever pivoted between its ends for generally vertical movement, a valve element on one end of said lever and engageable with said seat, and a weight on the other end of said lever urging said valve element upwardly.

6. An eduction unit according to claim 4, in which said second check valve includes a generally upwardly directed seat, a loose valve element normally engaging said seat, and a fixed cage surrounding said seat for restricting the distance that said loose element can move away from said seat, and for guiding its return thereto in response to gravity.

7. An eduction unit according to claim 1, including a connection between said first hose and said tank enabling pivoting therebetween about a vertical axis, said first hose having a horizontal extent from its said other end extending beyond said tank at various positions of said pivotal connection.

8. An eduction unit according to claim 1, including a connection between said second hose and said second check valve enabling said one end of said second hose to be disposed at various levels within said tank.

9. An eduction unit according to claim 8, including a float operative on said one end of said second hose to raise it, said float having less bouyancy than that needed to partially raise said one end of said second hose out of any liquid in said tank.

* * * * *